US005475755A

United States Patent [19]

Matsumoto

[11] Patent Number: 5,475,755

[45] Date of Patent: Dec. 12, 1995

[54] PASSWORD PROCESSING WHEREBY A FOREIGN PASSWORD IS REFERRED TO AFTER FAIL OF SEVERAL ATTEMPTS

[75] Inventor: Mariko Matsumoto, Tokyo, Japan

[73] Assignee: NEC Corporation, Tokyo, Japan

[21] Appl. No.: 239,395

[22] Filed: May 6, 1994

[30] Foreign Application Priority Data

May 11, 1993 [JP] Japan ..... 5-109230

[51] Int. Cl.[6] ..... H04K 1/00

[52] U.S. Cl. ..... 380/23; 235/382; 235/382.5; 380/4

[58] Field of Search ..... 380/3, 4, 23, 24, 380/25; 235/382, 382.5; 340/825.34, 825.33

[56] References Cited

U.S. PATENT DOCUMENTS 4,734,568 3/1988 Watanabe ..... 235/380
5,073,767 12/1991 Holmes et al. ..... 340/311.1
5,206,905 4/1993 Lee et al. ..... 380/23
5,323,465 6/1994 Avarne ..... 380/23

FOREIGN PATENT DOCUMENTS 60-191364 9/1985 Japan .
2236205 3/1991 United Kingdom .

*Primary Examiner*—David C. Cain
*Attorney, Agent, or Firm*—Sughrue, Mion, Zinn, Macpeak & Seas

[57] ABSTRACT

Only while correct passwords are supplied to a comparator (21) of a password processing device to put a utilization device (11) into operation, a processor (25) processes password information into a processed datum. If a foreign, incorrect password supplied to the comparator the utilization device is not put into operation, and the foreign password is stored in a memory (17) as a stored datum and is processed into the processed datum. If consecutively supplied, such foreign passwords are successively used in the stored datum. The processed datum is thereby rendered undefined. Preferably, the password information makes the processed datum twice or five times indicate a unique password. The utilization device is typically a receiver circuit of a selective call radio receiver.

11 Claims, 3 Drawing Sheets

PASSWORD PROCESSING WHEREBY A FOREIGN PASSWORD IS REFERRED TO AFTER FAIL OF SEVERAL ATTEMPTS

BACKGROUND TO THE INVENTION

This invention relates to password processing of processing passwords for a utilization device which is typically receiver circuitry of a selectively called portable radio receiver. The utilization device may be a cash dispenser connected to a bank on-line system. In this case, the password is what is usually called an identification number. More particularly, this invention relates to a password processing method and to a password processing device.

In a password processing device, a memory unit is preliminarily loaded with a unique password. Only when supplied with a correct password which correctly and exactly represents the unique password, a comparator puts the utilization device into operation. The password processing device rejects a foreign password which does not represent the unique password. In other words, attempts result in failure in putting the utilization device into operation when tried by one who is not authorized to use the utilization device.

A password processing device of the type described is disclosed in Japanese Patent Prepublication (A) No. 191,364 of 1985 by Mori-Ryôiti (transliteration in accordance with ISO 3602). In this Mori device, operation of the password processing device is suspended during a predetermined duration of time if an input password is the foreign one. The predetermined duration is, for example, twenty-four hours long. The Mori device is excellently operable to protect the utilization device against an illegal use by a hacker. The Mori device is, however, defective in that the hacker can put the utilization device into operation when attempts are repeated after lapse of each predetermined duration to tamper with the unique password.

Apparently independently improved password processing device and method are revealed by Thomas F. Holmes and two others in U.S. Pat. No. 5,073,767. This Holmes et al device is built in the utilization device and is disabled by an illegal use. The utilization device must therefore be returned to its manufacture for repair. Alternatively, the utilization device is inoperative unless its expensive components are replaced. More specifically, the password processing device is disabled or locked when supply thereto of guessed passwords fails a predetermined number of attempts. For example, the password processing device is locked out after seven times of failed attempts. Entire disabling of the utilization device is, however, objectionable depending on the circumstances. Incidentally, a programmable memory is used by Holmes et al to serve as the memory unit for storing the unique password and an encryption algorithm. It is described by Holmes et al to the effect that a subsequently entered correct password would functionally reenable the utilization device. Its details are, however, not clear.

SUMMARY OF THE INVENTION

In view of the foregoing, it is an object of the present invention to provide a password processing method of processing an input password to put a utilization device into operation, only when the input password is a correct password coincident with predetermined password information, and with no lock out of the password processing method.

It is another object of this invention to provide a password processing method which is of the type described and in which a processed datum is used to acknowledge the correct password and is rendered undefined when foreign passwords are used each as the input password more than twice to be incoincident with the password information.

It is still another object of this invention to provide a password processing method which is of the type described and in which the processed datum is rendered undefined after a predetermined number of attempts to illegally put the utilization device into operation by using various foreign passwords each as the input password.

It is yet another object of this invention to provide a password processing method which is of the type described and by which start of operation of the utilization device is very difficult for one who is unauthorized to do so.

It is a further object of this invention to provide a password processing method which is of the type described and by which start of operation is more difficult for an unauthorized person than a conventional password processing method which includes an operation lock out step.

It is a different object of this invention to provide a password processing device capable of putting into practice the password processing method of the type described.

Other objects of this invention will become clear as the description proceeds.

In accordance with an aspect of this invention, there is provided a password processing method which is for a utilization device and comprises the steps of: (A) generating a processed datum initially representative of password information; (B) comparing an input password with the processed datum to put the utilization device into operation upon detection of coincidence between the input password and the password information; and (C) rendering the processed datum undefined after a predetermined number of attempts to use foreign passwords each as the input password in the comparing step with detection of incoincidence between each foreign password and the password information.

In accordance with a different aspect of this invention, there is provided a password processing device which is for putting a utilization device into operation and comprises: (A) generating means for generating a processed datum initially representative of a unique password; (B) comparing means for comparing an input password with the processed datum to put the utilization device into operation upon detection of coincidence between the input password and the unique password; and (C) rendering means for rendering the processed datum undefined if foreign passwords are used each as the input password by the comparing means with detection of incoincidence between each foreign password and the unique password.

DESCRIPTION OF THE PREFERRED EMBODIMENT

Figure 1:
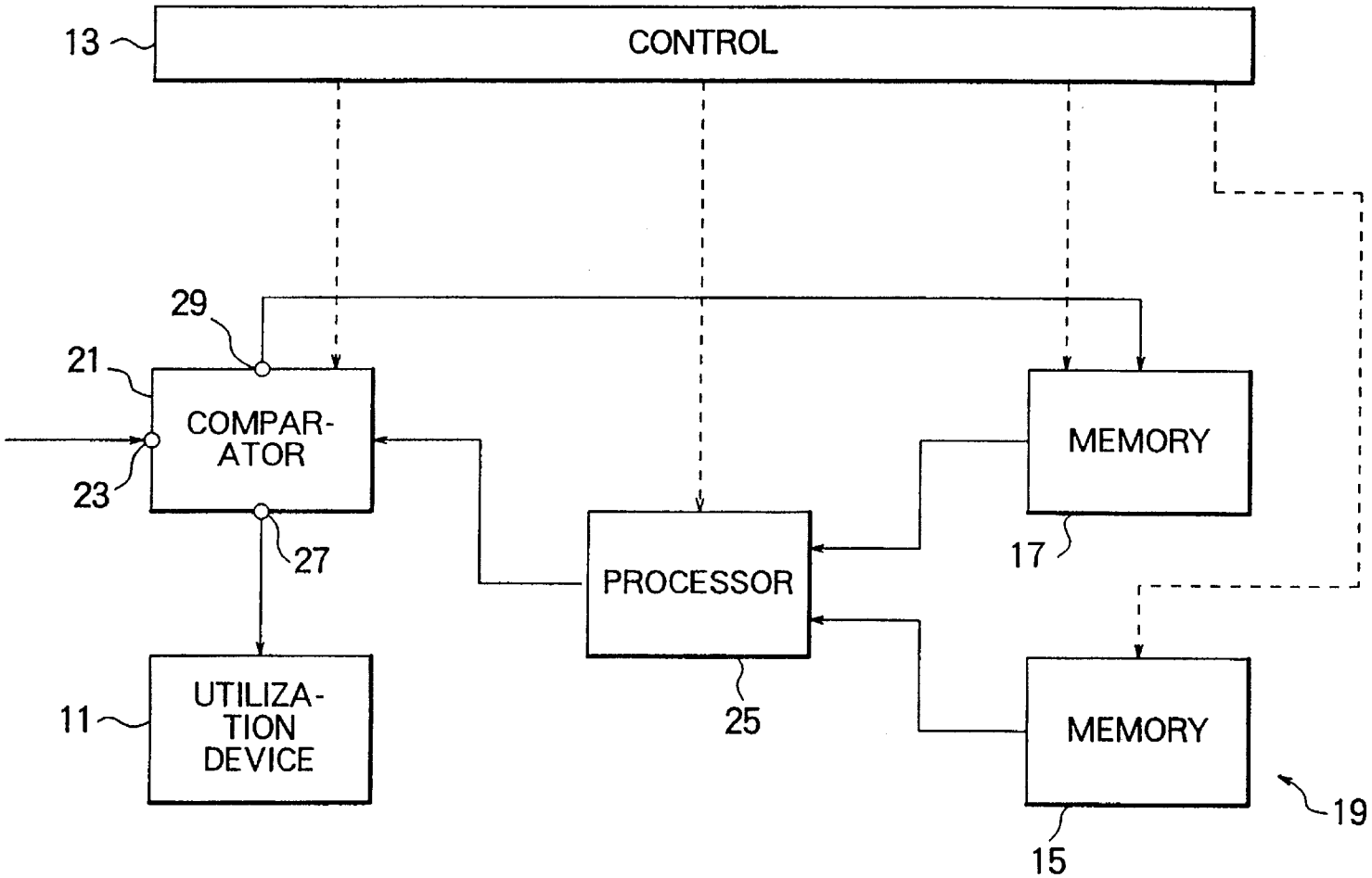
FIG. 1 shows in blocks a password processing device according to an embodiment of the instant invention together with a utilization device.

Referring to FIG. 1, a password processing device is one according to a preferred embodiment of the present invention and is for putting a utilization device 11 into operation. In the manner described heretobefore, the utilization device 11 is typically receiver circuitry of a selectively called portable radio receiver.

The password processing device is for processing passwords supplied thereto each as an input password. Only when the input password is a correct password representative of a unique password for the utilization device 11, the password processing device starts operation of the utilization device 11, namely, puts the utilization device 11 into operation.

In general, it is possible to supply such input passwords to a conventional password processing device until coincidence appears between one of the input passwords and the unique password. When supply of the input passwords is possible until appearance of the coincidence, an accidental coincidence may occur to erroneously or undesiredly put the utilization device 11 into operation.

In order to cope with such an inconvenience, the password processing device of FIG. 1 is operable under control by a control unit 13 in the manner which will become clear as the description proceeds. Briefly speaking, the control unit 13 monitors and controls various other parts of the password processing device. For this purpose, it is possible to understand that a program is stored in the control unit 13.

A primary memory part 15 is preliminarily loaded with a password datum representative of password information. A stored datum is later stored in a secondary memory part 17 as will presently be described. It is possible to use a single memory unit 19 with its memory areas used as the primary and the secondary memory parts 15 and 17. The unique password will be referred to as a password 0.

A comparator unit 21 has a password input port 23 supplied with the input passwords from time to time. Each input password may be the correct password. Depending on circumstances, a foreign password is supplied to the comparator unit 21 through the input port 23. The foreign password is incoincident with the unique password and may inadvertently be supplied to the comparator unit 21. Alternatively, such foreign passwords may be supplied to the comparator unit 21 by one who tampers with the password processing device. In such an event, the foreign passwords are coincident with the unique password only rarely by chance.

Connected between the memory unit 19 and a data input port of the comparator unit 21, a processor unit 25 processes contents of the primary and the secondary memory parts 15 and 17 into a processed datum for delivery to the comparator unit 21 through the data input port. Comparing each input password with the processed datum, the comparator unit 21 produces a result of comparison indicative of either coincidence or incoincidence between the input password and the unique password. Until the incoincidence is detected, the control unit 13 makes the processor unit 25 deal with the password datum. When the incoincidence is detected first between the processed datum and one of the input passwords that is the foreign password, the control unit 13 stores this one of the input passwords in the secondary memory part 17 as the stored datum and begins to make the processor unit 25 process the stored datum.

The comparator unit 21 has coincidence and incoincidence output ports 27 and 29 connected to the utilization device 11 and to the secondary memory part 17 respectively. When indicative of the coincidence, the result of comparison is delivered to the coincidence output port 27 as an operation start signal. Supplied with the operation start signal, the utilization device 11 is put into operation.

Figure 2:
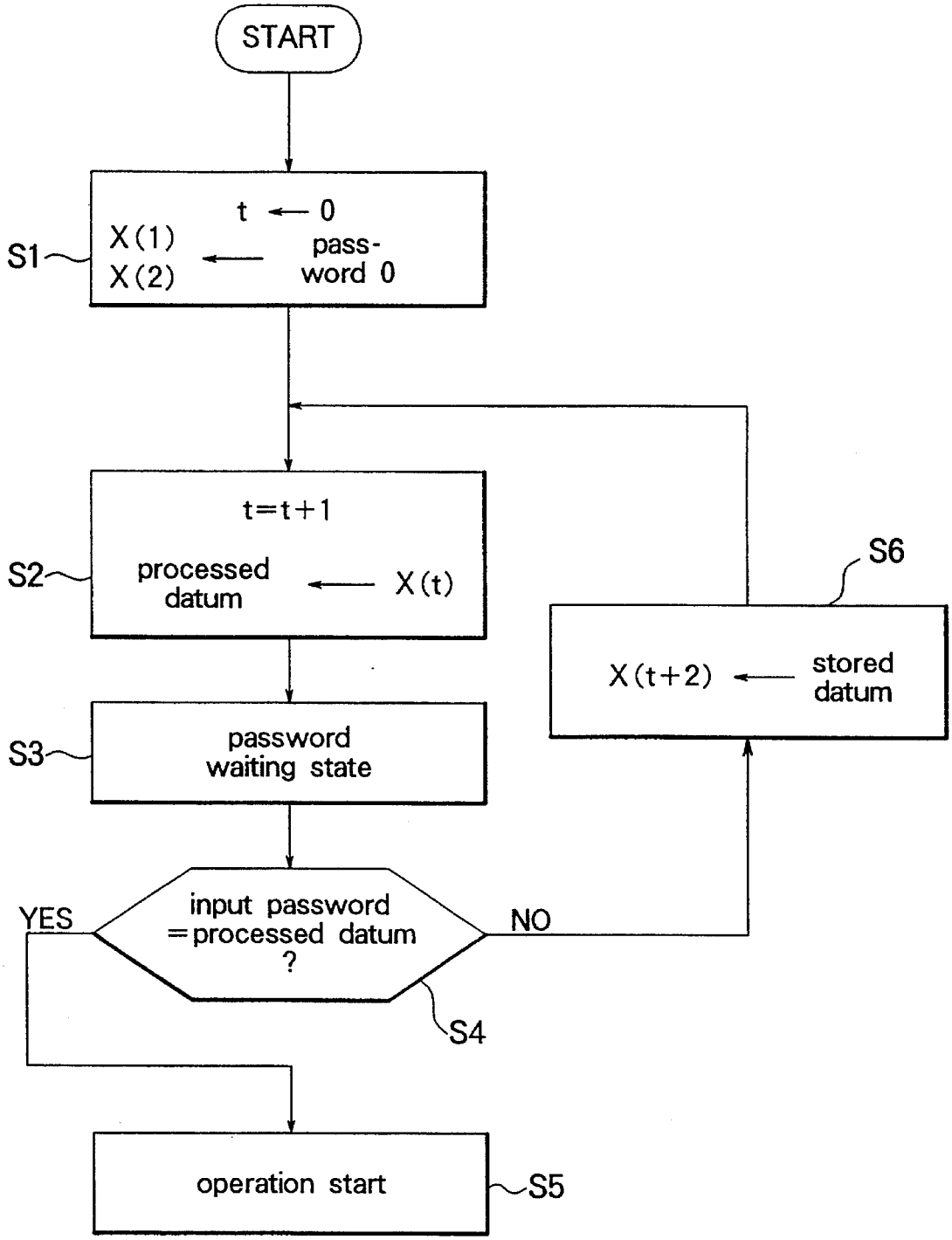
FIG. 2 shows a flow chart for use in describing operation of the password processing device depicted in FIG. 1.

Turning to FIG. 2 with FIG. 1 continuously referred to, the password processing device operates as follows when the input passwords are switched or changed from the correct password or passwords to the foreign password or passwords. Each time an input password is supplied to the comparator unit 21, namely, to the password processing device, a current time instant t proceeds one by one. Operation of the password processing device starts while the password processing device is in an initial state, where the time instant is said to be equal to 0.

In the manner depicted at a first stage S1, the password 0 is kept in the primary memory part 15 as a first datum X(1) and as a second datum X(2). The processed datum represents twice the password 0.

At the time instant t, the processed datum is given a current value X(t) as indicated at a second stage S2. The password processing device is kept at a password waiting state depicted at a third stage S3 after the time instants t and (t+1).

When a first input password is supplied to the password processing device, the comparator unit 21 compares the input password with the processed datum at a fourth stage S4. If the first input password is the correct password, the result of comparison between it and the first datum X(1) indicates a coincidence (YES). The comparator unit 21 delivers the operation start signal to the utilization device 11 to start operation of the utilization device 11 at a fifth stage S5.

It will be assumed that a second input password is supplied to the password processing device at the time instant (t+1). The comparator unit 21 compares the second input password with the second datum X(2), still password 0, at the fourth stage S4. If an incoincidence (NO) is first detected, the second input password is a first foreign password. Each foreign password has a different datum X(h), where h represents an integer greater than two. Detecting the incoincidence, the control unit 13 makes the secondary memory part 17 now supply the stored datum to the processing unit 25 to make the processed datum indicate the above-mentioned foreign passwords as a third datum X(3).

Meanwhile, a third input password is supplied to the password processing device. Responsive to supply of the third input password to the comparator unit 21, the control unit 13 makes the processing unit 25 first refer to the primary memory part 15 to make the processed datum indicate the password 0, namely, the unique password. If the third input password is the correct password, the fourth stage S4 results in indication of the coincidence. In that case the utilization device 11 is again put into operation at the second stage S5.

If the third input password is instead a second consecutive foreign password, the comparison in the fourth stage S4 results in an indication of incoincidence. Responsive to this indication, the comparator unit 21 makes the processor unit 25 refer to the secondary memory part 17. The stored datum (i.e., a value indicating X(3), the first foreign password) is processed into the processed datum. The foreign password under consideration is incoincident with the third datum X(3). The fourth stage S4 proceeds to a sixth stage S6. At the sixth stage S6, this second foreign password is stored in the secondary memory part 17 and is substituted for the preceding foreign password, making make the stored datum represent a substituted datum X(t+ 2). The sixth stage S6 proceeds back to the second stage S2 with one added to the current time instant t. Similar operation follows.

In the example just illustrated, foreign passwords are successively substituted for the content of the stored datum when two foreign passwords are consecutively used as input passwords. These two foreign passwords may or may not be subsequent to the correct password or passwords. Once two consecutive foreign passwords are entered, in the stored datum, the password processing device detects an incoincidence even when subsequently supplied with the correct password. When the password processing device is in this state, the processed datum generated in stage S2 is said to be undefined.

In review, the processed datum is rendered undefined when the password processing device is supplied with two or more consecutive foreign passwords following supply thereto of the correct password or passwords with no correct password interposed between two foreign passwords first supplied thereto following the correct password or passwords. These two or more foreign passwords may also be supplied to the password processing device while the password processing device is in the initial state. Hence, it is very difficult even for one authorized to use the password processing device and the utilization device 11 to know when the processed datum is rendered undefined. Obviously, when two or more consecutive instances of the correct password are input the processed datum will thereafter be returned to its initial, defined state and subsequent correct passwords will put the utilization device into operation.

More specifically, first through fourth and other time instants of supply of the foreign passwords to the password processing device will be taken into consideration as t=1, 2, 3, 4, and so forth. When supplied at these time instants, the input passwords will be referred to as first through the fourth input passwords and so on. With the first input password assumed to be the correct password denoted by A, the second and the third input passwords will be assumed as first and second foreign passwords denoted by B and C. The second and subsequent time instants are indicative of the number of attempts to put the utilization device 11 into operation which fail.

In a list which follows, a total number of times of supply of the input passwords to the password processing device is represented by k in a leftmost column preceding a next column for the number of attempts t. The processed datum is represented by PD. Represented by each input password, an input datum is denoted by ID. When produced, the operation start signal is indicated by a small circle in a rightmost column denoted by OS. Production of no operation start signal is indicated in the column OS by short horizontal lines.

LIST

| k | t | PD | ID | OS |
|---|---|---|---|---|
| K − 2 | 1 | A | B | — |
| K − 1 | 2 | A | C | — |
| K | 3 | B | A | — |
| K + 1 | 4 | C | C | o |

It is surmised in the list at the first time instant that the password datum represents the unique password 0 (represented by "A"). When the input password is the first foreign password B at this time instant, the comparator unit 21 detects the incoincidence. The operation start signal is not produced. Being supplied to the password processing device for the first time, this foreign password B is stored in the second memory part 17 as the stored datum.

At the second time instant, the processed datum still indicates the correct password A. If the input password is the second foreign password C, the operation start command is not yet produced. Inasmuch as the foreign passwords are twice supplied unsuccessfully to the password processing device, namely, inasmuch as the attempts are twice tried in vain, the first foreign password B is substituted for the first foreign password of the stored datum. It should be noted that the first foreign password B is used in this event rather than the second foreign password C which is currently supplied to the password processing device.

At the third time instant, the processed datum represents the first foreign password B. Even though the correct password A is supplied to the password detecting device at this time instant, the comparator unit 21 detects an incoincidence. Although the correct password, the third input password is treated as a foreign password. The second foreign password C is now substituted for the first foreign password B in the stored datum.

At the fourth time instant, the processed datum represents the second foreign password C. If supplied to the password detecting device at the fourth time instant accidentally as the fourth input password, the second foreign password C happens to be coincident with the second foreign password C indicated by the processed datum. The utilization device 11 is put by rare chance into operation. In the stored datum, the second foreign password C is kept unchanged.

In the manner described in the foregoing, the processed datum initially represents the unique password 0 in the example being illustrated. When the incoincidence is later detected between the input password and the unique password 0 represented by the processed datum, this input password is stored in the secondary memory part 17 as the stored datum. The processor unit 25 processes the stored datum into the processed datum. In this manner, the processed datum is rendered indefinite.

Directing attention to the total number k of supply of the input passwords to the password detecting device, the processed datum indicates at a later time instant K the foreign password, such as B, used as the input password at a former time instant (K-2). The stored datum is successively changed at a later time instant K to when the foreign password was used as the input password at a former time instant which may be (K-k'), where k' represents a predetermined integer which is equal to two or greater.

This predetermined integer is readily selected by the program stored in the control unit 13. In addition, it is possible by the program to optionally select the number used as a preselected number, such as two of attempts of using the foreign password each as the input password on trying to put the utilization device 11 unsuccessfully into operation. Furthermore, it is possible to start reference by the processor unit 25 to the stored datum after a small number, such as when one of the foreign password or passwords are inadvertently used following the initial state. The program may be stored alternatively in the processing unit 25 or somewhere else. It should be noted in the example illustrated above that the unique password 0 per se is used as the password information.

Further turning to FIG. 3 with FIGS. 1 and 2 continuously referred to, the password processing device is operable in a different manner as follows. After start of operation and having executed first and second modified stages SM1 and SM2, the password processing device is put in the third through the fifth stages S3 to S5 of operation described above. When an incoincidence (NO) is detected at the fourth stage S4, a sixth modified stage SM6 follows to return to the second modified stage SM2.

For use in the first modified stage, a plurality of pairs of primary and secondary password values X(u) and X(u+1) are preliminarily stored in the primary memory part 15 as the password information. In the example being illustrated, the pairs are five pairs. As depicted in the first modified stage SM1, the password values of successive pairs are X(1) and X(2), . . . , and X(9) and X(10). Each of the primary password values are equal to 22. Each secondary password value is equal to 44.

Time instants t and (t+1) will be taken into consideration collectively as a current time instant. The processor unit 25 processes two password values X(t) and X(t+1) into a datum of the processed datum in accordance with an equation:

$$\text{processed datum}=(X(t)+X(t+1))/2.$$

While the input passwords are the correct passwords, the primary and the secondary password values of each pair are used in this manner collectively as the password datum. The processed datum consequently represents 33 as the unique password 0.

Under the circumstances, the predetermined number of times is five times. As a result, the substituted datum is given in the sixth modified stage SM6 by X(t+10).

Figure 3:
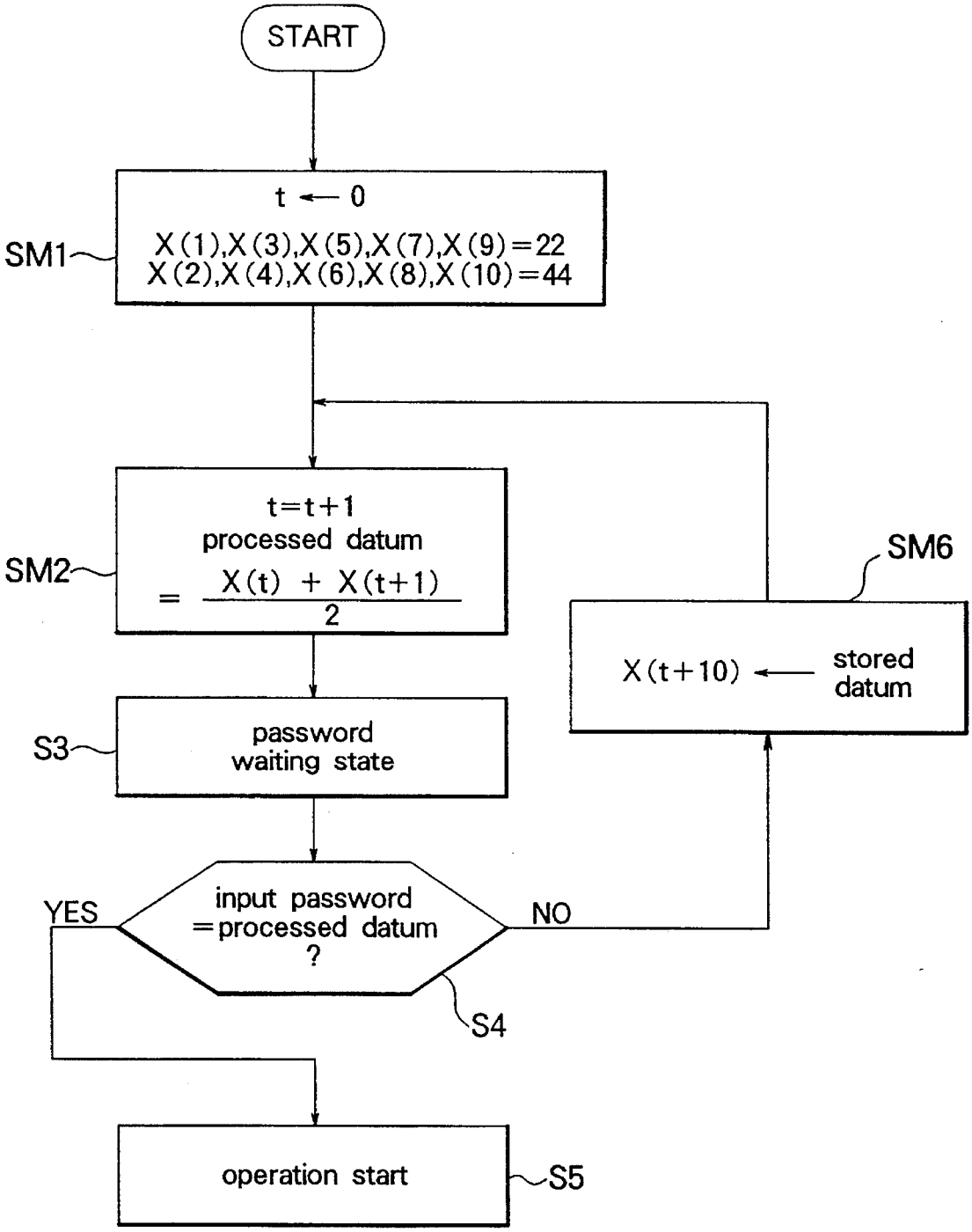
FIG. 3 shows another flow chart for use in describing a different operation of the password processing device depicted in FIG. 1.

Reviewing FIGS. 1 through 3, it is possible to make the processor unit 25 process the password datum and the stored datum in a variety of manners in accordance with the program. The password processing device is suitable for use in a selectively called portable radio receiver which comprises a code programmer, namely, which is a code programmable selective call radio receiver.

While this invention has thus far described in specific conjunction with a sole embodiment thereof and two modes of operation together with several modifications, it will now be readily possible for those skilled in the art to put this invention into practice in various other manners. For example, it is possible to use the password processing device in putting a cash dispenser in the manner described hereinabove with a number of identification numbers stored in the primary memory part 15 as the password information and with use of a like number of secondary memories, such as the secondary memory part 17.

What is claimed is:

1. A password processing method for a utilization device, comprising the steps of:

generating a processed datum initially representative of a unique password;

comparing an input password with said processed datum to put said utilization device into operation upon detection of coincidence between said input password and said unique password;

rendering said processed datum in an undefined condition if foreign passwords are used each as said input password in said comparing step with detection of non-coincidence between each foreign password and said unique password;

said generating step comprising the steps of:

storing a password datum representative of password information;

storing said input password as a stored datum upon first indication of said non-coincidence in said comparing step;

initially processing the password information of said password datum into said unique password before said first indication to make said processed datum indicate said unique password; and later processing said stored datum into said processed datum after said first indication;

said rendering step substituting said foreign passwords successively for the input password in said stored datum if said foreign passwords are consecutively used, each as said input password, in said comparing step after said first indication;

said undefined condition existing when said unique password is not contained in said processed datum.

2. A password processing method as claimed in claim 1, wherein said password information makes said processed datum indicate said unique password a predetermined number of times.

3. A password processing method as claimed in claim 2, wherein said predetermined number of times is twice.

4. A password processing method as claimed in claim 2, wherein:

said password data storing step stores five pairs of password values as said password information;

said initial processing step processing the password values of each pair into said unique password to render said predetermined number of times equal to five times.

5. A password processing device for putting a utilization device into operation, comprising:

generating means for generating a processed datum initially representative of a unique password;

comparing means for comparing an input password with said processed datum to put said utilization device into operation upon detection of coincidence between said input password and said unique password; and rendering means for rendering said processed datum in an undefined condition if foreign passwords are used, each as said input password to make said comparing means detect non-coincidence between each foreign password and said unique password;

said generating means comprising:

first storing means for storing a password datum representative of password information;

second storing means for storing said input password as a stored datum upon first indication of said non-coincidence by said comparing means;

initial processing means for processing the password information of said password datum into said unique password before said first indication to make said processed datum indicate said unique password; and later processing means for processing said stored datum into said processed datum after said first indication;

said rendering means substituting said foreign passwords successively for the input password in said stored datum if said foreign passwords are consecutively used each as said input password by said comparing means after said first indication;

said undefined condition existing when said unique password is not contained in said processed datum.

6. A password processing device as claimed in claim 5, wherein:

said password information is stored in said first storing means as said password datum to indicate said unique password a predetermined number of times.

7. A password processing device as claimed in claim 6, wherein said predetermined number of times is twice.

8. A password processing device as claimed in claim 6, wherein:

said password information is stored in said first storing means as said password datum to indicate five pairs of password values;

said initially processing means processing the password values of each pair into said unique value to render said predetermined number of times equal to five times.

9. A code programmable selective call radio receiver comprising receiver circuitry and a password processing device for putting said receiver circuitry into operation, said password processing device comprising:

generating means for generating a processed datum initially representative of a unique password;

comparing means for comparing an input password with said processed datum to put said receiver circuitry into operation upon detection of coincidence between said input password and said unique password; and rendering means for rendering said processed datum in an undefined condition if foreign passwords are used, each as said input password, by said comparing means, upon detection of non-coincidence between each foreign password and said unique password;

said generating means comprising:

first storing means for storing a password datum representative of password information;

second storing means for storing said input password as a stored datum upon first indication of said non-coincidence by said comparing means;

initial processing means for processing the password information of said password datum into said unique password before said first indication to make said processed datum indicate said unique password; and later processing means for processing said stored datum with said processed datum after said first indication;

said rendering means substituting said foreign passwords successively for the input password in said stored datum if said foreign passwords are consecutively used each as said input password by said comparing means after said first indication;

said undefined condition existing when said unique password is not contained in said processed datum.

10. A password processing method for a utilization device, comprising the steps of:

generating a processed datum initially representative of a unique password;

comparing each input password, of a plurality of input passwords, with said processed datum to put said utilization device into operation upon detection of coincidence between said input password and said unique password;

rendering said processed datum in an undefined state if foreign passwords are used, each as said input password, in said comparing step upon detection of non-coincidence between each foreign password and said unique password; and returning said processed datum to a defined state upon detection of a pre-defined number of consecutive said input passwords which coincide with said unique password;

said undefined state existing when said unique password is not represented in said processed datum;

said defined state existing when said unique password is represented in said processed datum.

11. A password processing method as claimed in claim 10, wherein said rendering step comprises the step of modifying said processed datum in response to consecutive foreign passwords each used as said input password.

* * * * *